US007883387B2

(12) United States Patent
Yang et al.

(10) Patent No.: US 7,883,387 B2
(45) Date of Patent: Feb. 8, 2011

(54) PULSED HIGH-VOLTAGE SILICON QUANTUM DOT FLUORESCENT LAMP

(75) Inventors: Tsun-Neng Yang, Taipei (TW); Shan-Ming Lan, Taoyuan County (TW); Chin-Chen Chiang, Taoyuan County (TW); Wei-Yang Ma, Taipei County (TW); Chien-Te Ku, Taoyuan County (TW)

(73) Assignee: Atomic Energy Council-Institute of Nuclear Energy Research, Taoyuan (TW)

( * ) Notice: Subject to any disclaimer, the term of this patent is extended or adjusted under 35 U.S.C. 154(b) by 41 days.

(21) Appl. No.: 11/898,344

(22) Filed: Sep. 11, 2007

(65) Prior Publication Data

US 2010/0216266 A1 Aug. 26, 2010

(51) Int. Cl.
*H01J 9/00* (2006.01)
*B05D 5/06* (2006.01)
*B05D 5/12* (2006.01)

(52) U.S. Cl. ..... 445/24; 445/25; 445/14; 445/50; 427/64; 427/67; 427/78

(58) Field of Classification Search ..... 445/14, 445/24–27, 49–51; 427/58, 64, 67, 77, 78
See application file for complete search history.

(56) References Cited

U.S. PATENT DOCUMENTS 5,442,254 A * 8/1995 Jaskie ..... 313/485
5,455,489 A * 10/1995 Bhargava ..... 315/169.4
5,882,779 A * 3/1999 Lawandy ..... 427/64
7,132,783 B1 * 11/2006 Kambe et al. ..... 313/496
7,569,984 B2 * 8/2009 Yang et al. ..... 445/24
2010/0255747 A1 * 10/2010 Yang et al. ..... 445/58

* cited by examiner

*Primary Examiner*—Mariceli Santiago
(74) *Attorney, Agent, or Firm*—Jackson IPG PLLC; Demian K. Jackson

(57) ABSTRACT

In a method for making a pulsed high-voltage silicon quantum dot fluorescent lamp, an excitation source is made by providing a first substrate, coating the first substrate with a buffer layer of titanium, coating the buffer layer with a catalytic layer of a material selected from a group consisting of nickel, aluminum and platinum and providing a plurality of nanometer discharging elements one the catalytic layer. An emission source is made by providing a second substrate, coating the second substrate with a transparent electrode film of titanium nitride and coating the transparent electrode film with a silicon quantum dot fluorescent film comprising silicon quantum dots. A pulsed high-voltage source is provided between the excitation source and the emission source to generate a pulsed field-effect electric field to cause the nanometer discharging elements to release electrons and accelerate the electrons to excite the silicon quantum dots to emit pulsed visible light.

17 Claims, 8 Drawing Sheets

PULSED HIGH-VOLTAGE SILICON QUANTUM DOT FLUORESCENT LAMP

BACKGROUND OF INVENTION

1. Field of Invention

The present invention relates to a method for making a pulsed high-voltage silicon quantum dot fluorescent lamp and, more particularly, to a method for making a pulsed high-voltage silicon quantum dot fluorescent lamp for providing pulsed visible light by exciting the silicon quantum dots of a silicon quantum dot fluorescent film by a pulsed field-effect electron source consisting of a pulsed high-voltage source and a cathode assembly including nanometer carbon tubes or nanometer silicon wires.

2. Related Prior Art

Mercury-based fluorescent lamps are widely used for illumination. In the mercury-based fluorescent lamp, mercury vapor discharge is used to radiate ultraviolet light. The ultraviolet light is used to excite a first material to emit red light, a second material to emit green light and a third material to emit blue light. The first, second and third materials are used together to emit white light. The mercury used in the mercury-based fluorescent lamps is however dangerous to the environment.

White lamps include traditional Edison light bulbs and fluorescent light tubes and increasingly popular lamps using light-emitting diodes ("LED"). A white-light LED-based lamp is provided in various manners as follows:

Firstly, a red-light LED, a green-light LED and a blue-light LED are used together. The illuminative efficiency is high. However, the structure is complicated for including many electrodes and wires. The size is large. The process is complicated for involving many steps of wiring. The cost is high. The wiring could cause disconnection of the wires and damages to the crystalline grains, thus affecting the throughput.

Secondly, a blue-light LED and yellow fluorescent powder are used. The size is small, and the cost low. However, the structure is still complicated for including many electrodes and wires. The process is still complicated for involving many steps of wiring. The wiring could cause disconnection of the wires and damages to the crystalline grains, thus affecting the throughput.

Thirdly, an ultra-light LED and white fluorescent powder are used. The process is simple, and the cost low. However, the resultant light includes two separate spectrums. A red object looks orange under the resultant light because of light polarization. The color rendering index is poor. Furthermore, the decay of the luminosity is serious. The quality of fluorescent material deteriorates in a harsh environment. The lamp therefore suffers a short light and serious light polarization.

Moreover, when viewed directly, the light emitted from the LED-based lamps is harsh to human eyes.

The present invention is therefore intended to obviate or at least alleviate the problems encountered in prior art.

SUMMARY OF INVENTION

The primary objective of the present invention to provide a pulsed high-voltage silicon quantum dot fluorescent lamp for providing pulsed light by exciting the silicon quantum dots of a silicon quantum dot fluorescent film by a pulsed field-effect electron source consisting of a pulsed high-voltage source and a cathode assembly including nanometer carbon tubes or nanometer silicon wires.

To achieve the foregoing objective of the present invention, there is provided a method for making a pulsed high-voltage silicon quantum dot fluorescent lamp. An excitation source is made by providing a first substrate, coating the first substrate with a buffer layer of titanium, coating the buffer layer with a catalytic layer of a material selected from a group consisting of nickel, aluminum and platinum and providing a plurality of nanometer discharging elements one the catalytic layer. An emission source is made by providing a second substrate, coating the second substrate with a transparent electrode foil of titanium nitride and coating the transparent electrode film with a silicon quantum dot fluorescent film comprising silicon quantum dots. A pulsed high-voltage source is provided between the excitation source and the emission source to generate a pulsed field-effect electric field to cause the nanometer discharging elements to release electrons and accelerate the electrons to excite the silicon quantum dots to emit pulsed visible light.

Other objectives, advantages and features of the present invention will become apparent from the following description referring to the attached drawings.

BRIEF DESCRIPTION OF DRAWINGS

The present invention will be described via detailed illustration of the two embodiments referring to the drawings.

DETAILED DESCRIPTION OF EMBODIMENTS

Referring to FIGS. 1 through 6, there is shown a method for making a pulsed high-voltage silicon quantum dot fluorescent lamp 1.

Figure 1:
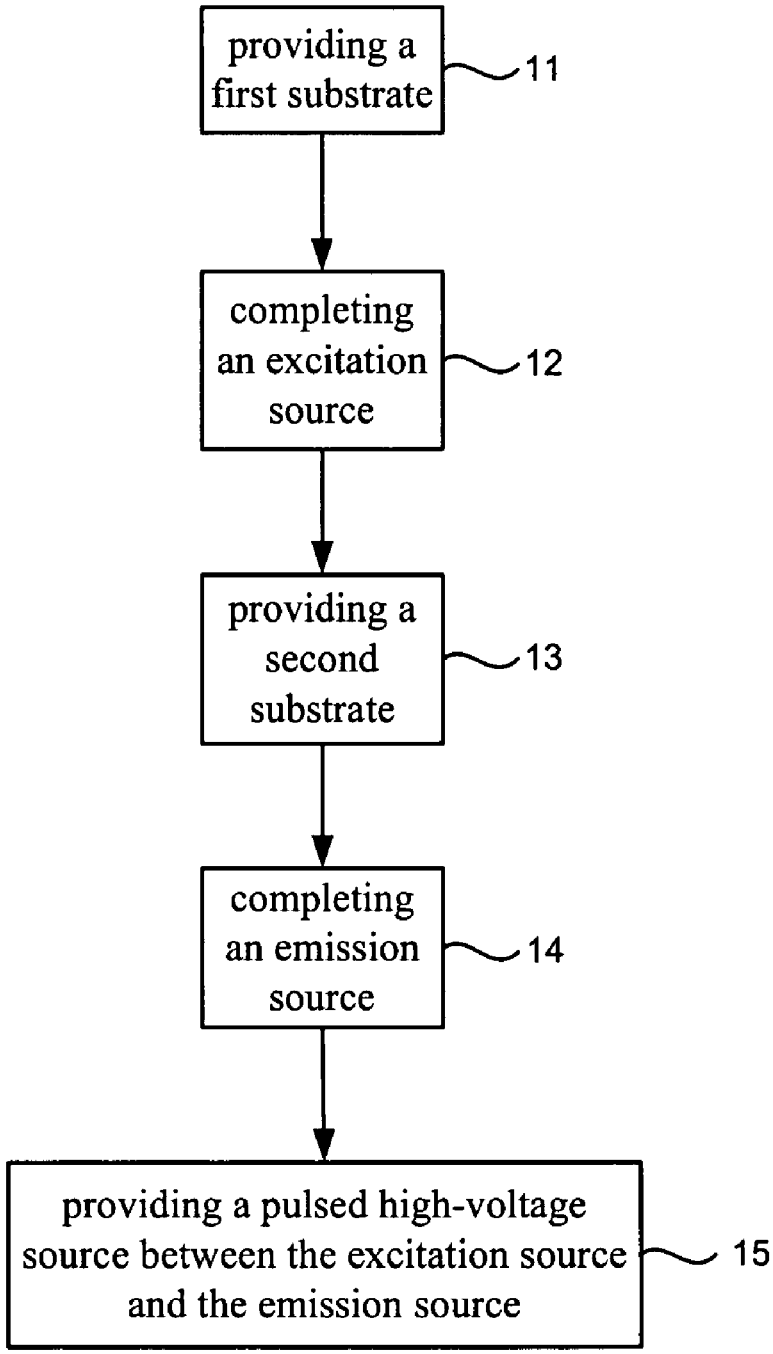
FIG. 1 is a flowchart of a method for making a pulsed high-voltage silicon quantum dot fluorescent lamp according to the first embodiment of the present invention.
Figure 2:
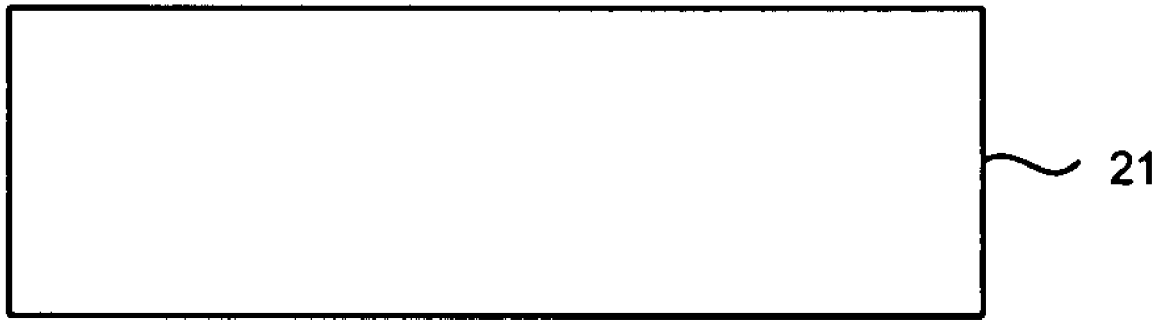
FIG. 2 is a side view of a first substrate for use in the method shown in FIG. 1.

Referring to FIGS. 1 and 2, at 11, a first substrate 21 is provided. The first substrate 21 is made of silicon, glass, ceramic or stainless steel.

Figure 3:
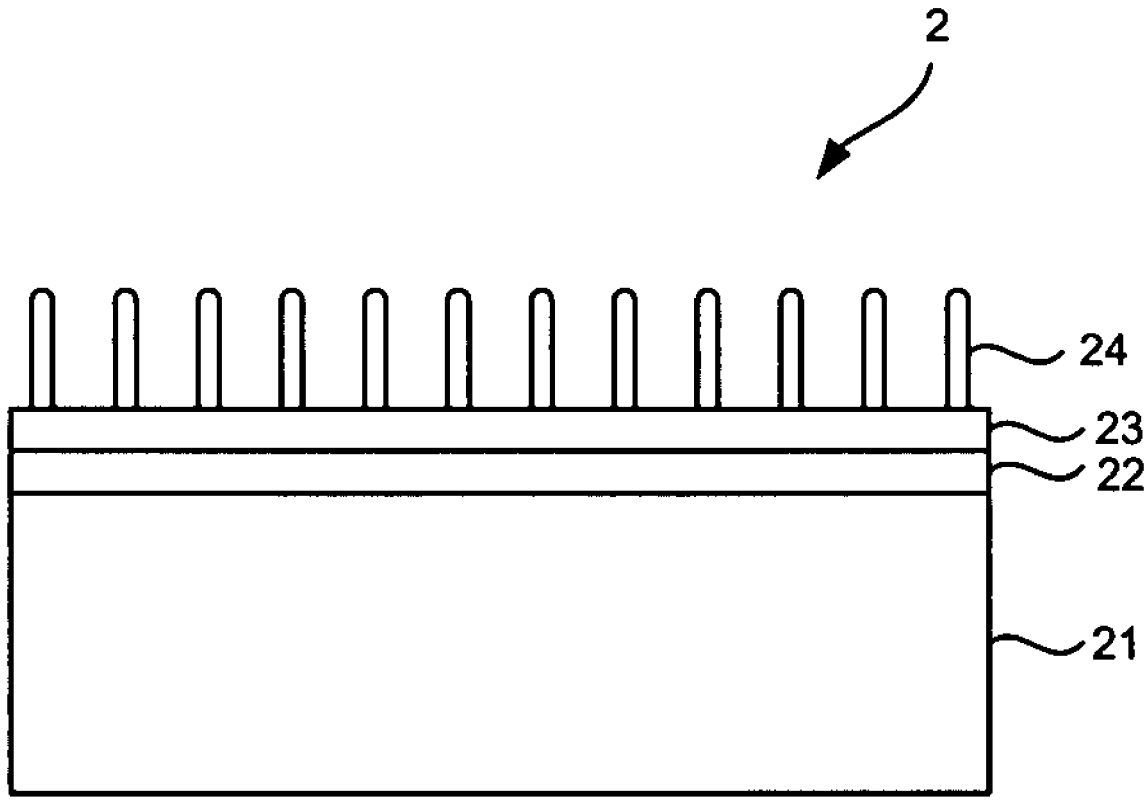
FIG. 3 is a side view of a cathode assembly, i.e., an excitation source including the first substrate show in FIG. 2.

Referring to FIGS. 1 and 3, at 12, an excitation source 2 is completed. The substrate 21 is coated with a buffer layer 22. The buffer layer 22 is coated with a catalytic layer 23. The coating is done by an e-gun evaporation system or a sputtering system. The buffer layer 22 is made of titanium. The catalytic layer 23 is made of nickel, aluminum or platinum. Nanometer carbon tubes 24 are provided on the catalytic layer 23 by chemical vapor deposition ("CVD") in which ethane or methane is used as a carbon source. The nanometer carbon tubes 24 are made of nanometer sizes and with conductivity. The nanometer carbon tubes 24 are used as nanometer discharging elements to discharge when subjected to an adequate voltage.

Figure 4:
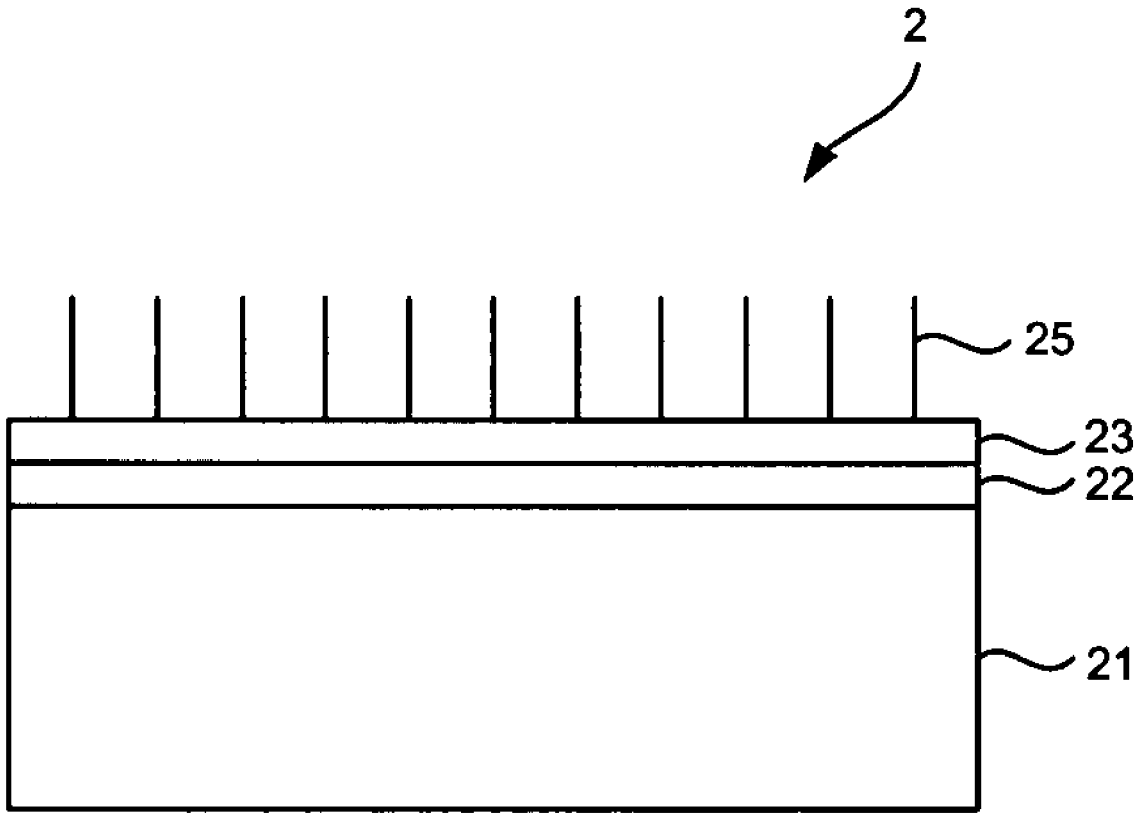
FIG. 4 is a side view of a second substrate for use in the method shown in FIG. 1.

Referring to FIGS. 1 and 4, at 13, a second substrate 31 is provided. The second substrate 31 is made of a transparent material such as glass, quartz and sapphire.

Figure 5:
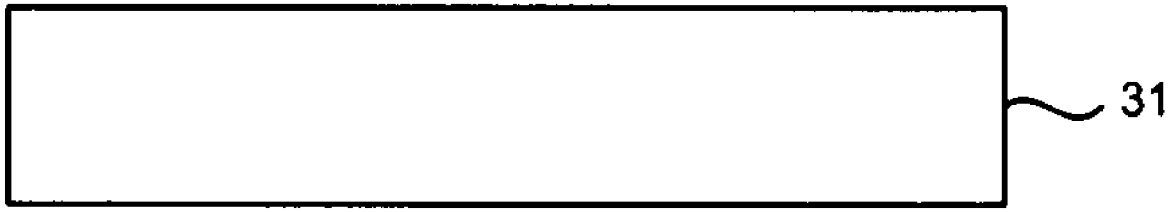
FIG. 5 is a side view of an anode assembly including the second substrate shown in FIG. 4.

Referring to FIGS. 1 and 5, at 14, an emission source 3 is completed. The second substrate 31 is coated with a transparent electrode foil 32 by the e-gun evaporation system or the sputtering system. The transparent electrode film 32 is made of titanium nitride for example. The thickness of the transparent electrode film 32 is smaller than 2000 angstroms. The transparent electrode film 32 is coated with a silicon quantum dot fluorescent film 33 by CVD for example. The silicon quantum dot fluorescent film 33 is made with a high dielectric coefficient. The silicon quantum dot fluorescent film 33 is a matrix made of a conductive or none-conductive material such as polymer, silicon oxide, silicon nitride and silicon carbide. The silicon quantum dot fluorescent film 33 includes silicon quantum dots 331 of various sizes such as 1 to 10 nanometers.

Figure 6:
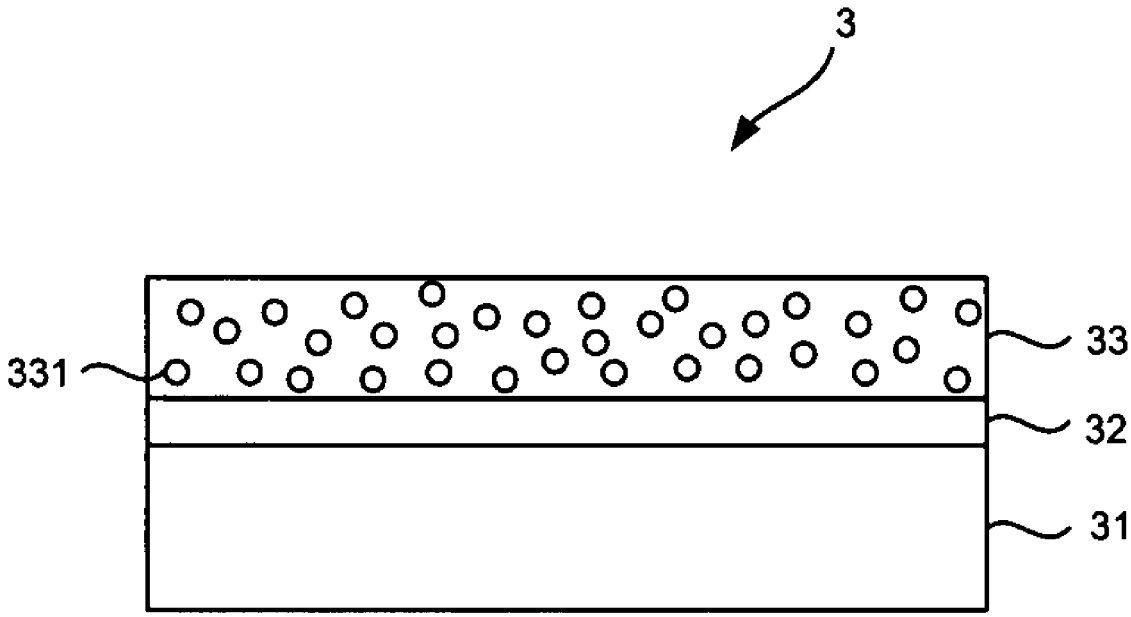
FIG. 6 is a side view of a pulsed high-voltage silicon quantum dot fluorescent lamp made in the method shown in FIG. 1.

Referring to FIGS. 1 and 6, the pulsed high-voltage silicon quantum dot fluorescent lamp 1 is completed by providing a pulsed high-voltage source 4 between the excitation source 2 and the emission source 3. The excitation source 2 is used as a cathode assembly. The emission source 3 is used as an anode assembly.

In operation, the pulsed high-voltage source 4 generates high-voltage pulses between the excitation source 2 and the emission source 3. The voltage of the high-voltage pulses varies from 1 to 10000 volts for example. Each of the pulses lasts form 0.1 to 100 millisecond. There is a gap form 0.1 to 10 millisecond between two adjacent one of the pulses. The pulsed high-voltage source 4 generates a potential difference between the excitation source 2 used as the cathode assembly and the emission source used as the anode assembly. The potential difference generates a pulsed field-effect electric field to cause the nanometer carbon tubes 24 of the excitation source 2 to release electrons and accelerate the electrons. The electrons hit and excite the silicon quantum dots 331 of the silicon quantum dot fluorescent film 33. When excited, the silicon quantum dots 331 of the silicon quantum dot fluorescent film 33 emit visible light. Thus, a pulsed visible light source is made. The pulsed high-voltage silicon quantum dot fluorescent lamp 1 is a flat panel fluorescent lamp.

Figure 7:
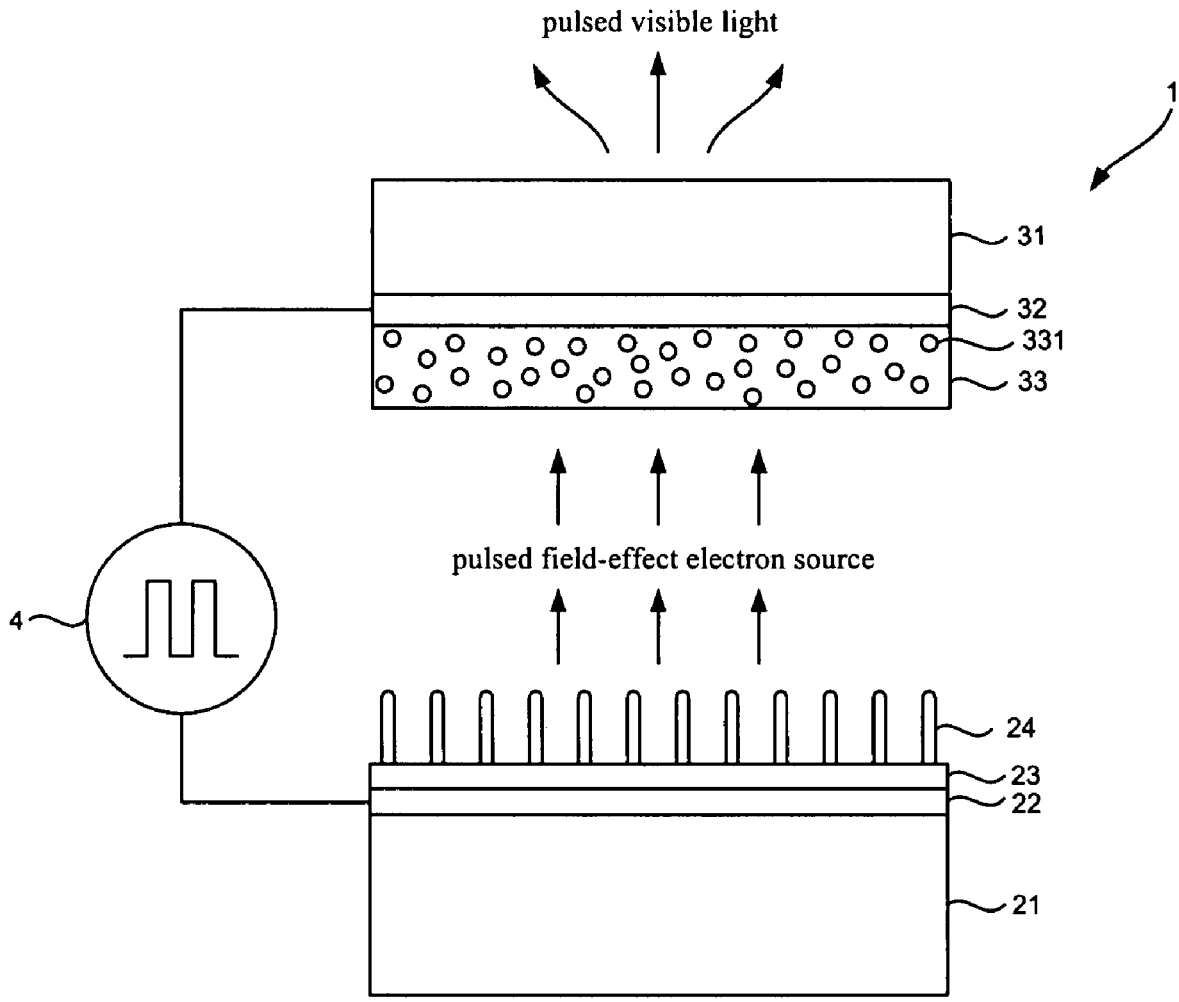
FIG. 7 is a side view of a cathode assembly made in a method according to the second embodiment of the present invention.
Figure 8:
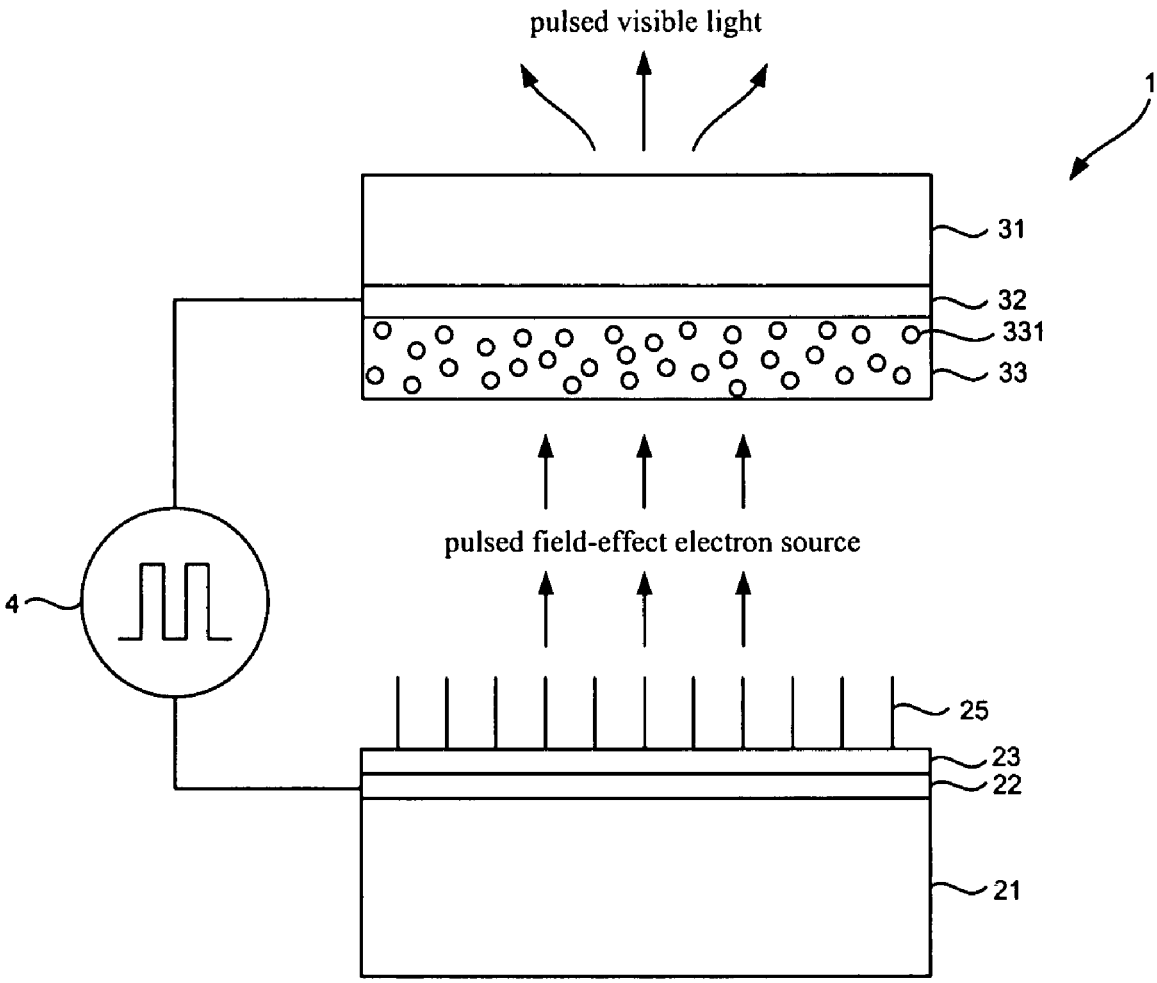
FIG. 8 is a side view of a pulsed high-voltage silicon quantum dot fluorescent lamp including the cathode assembly shown in FIG. 7.

Referring to FIGS. 7 and 8, there is shown a pulsed high-voltage silicon quantum dot fluorescent lamp made in a method according to a second embodiment of the present invention. The second embodiment is identical to the first embodiment except one thing. At 12, instead of the nanometer carbon tubes 24, nanometer silicon wires 25 are provided on the catalytic layer 23 by CVD in which monosilane or dichlorosilane is used as a silicon source. The nanometer silicon wires 25 are also made of nanometer sizes and with conductivity.

Conclusively, the pulsed high-voltage silicon quantum dot fluorescent lamp 1 exhibits at least one advantage over the conventional lamps mentioned in the RELATED PRIOR ART. It is economic regarding energy. That is, it provides stable pulsed visible light of high luminance at the price of a little energy.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A method for making a pulsed high-voltage silicon quantum dot fluorescent lamp, the method comprising the steps of providing an excitation source by the steps of:

providing a first substrate;

coating the first substrate with a buffer layer of titanium;

coating the buffer layer with a catalytic layer of a material selected from a group consisting of nickel, aluminum and platinum; and providing a plurality of nanometer discharging elements one the catalytic layer;

providing an emission source by the steps of:

providing a second substrate;

coating the second substrate with a transparent electrode film of titanium nitride; and coating the transparent electrode film with a silicon quantum dot fluorescent film comprising silicon quantum dots; and providing a pulsed high-voltage source between the excitation source and the emission source to generate a pulsed field-effect electric field to cause the nanometer discharging elements to release electrons and accelerate the electrons to excite the silicon quantum dots to emit pulsed visible light.

2. The method according to claim 1, wherein the first substrate is made of a material selected from a group consisting of silicon, glass, ceramic and stainless steel.

3. The method according to claim 1, wherein the nanometer discharging elements are nanometer carbon tubes provided by chemical vapor deposition in which a carbon source is selected from a group consisting of ethane and methane.

4. The method according to claim 1, wherein the nanometer discharging elements are nanometer silicon wires provided by chemical vapor deposition in which a silicon source is selected from a group consisting of monosilane and dichlorosilane.

5. The method according to claim 1, wherein the second substrate is transparent.

6. The method according to claim 1, wherein the second substrate is made of a material selected from a group consisting of glass, quartz and sapphire.

7. The method according to claim 1, wherein the silicon quantum dot fluorescent film is made of a material selected from a group consisting of polymer, silicon oxide, silicon nitride and silicon carbide.

8. The method according to claim 1, wherein the silicon quantum dot fluorescent film is made with a high dielectric coefficient.

9. The method according to claim 1, wherein the silicon quantum dots are made of various sizes of 1 to 10 nanometers.

10. The method according to claim 1, wherein the pulsed high-voltage source provides a potential difference to generate a field-effect electric field.

11. The method according to claim 1, wherein the pulsed high-voltage source generates high-voltage pulses at 1 to 10000 volts.

12. The method according to claim 11, wherein each of the pulses lasts 0.1 to 100 milliseconds.

13. The method according to claim 1, wherein there is a gap of 0.1 to 10 milliseconds between adjacent ones of the high-voltage pulses.

14. The method according to claim 1, wherein the thickness of the transparent electrode foil is smaller than 2000 angstroms.

15. The method according to claim 1, wherein the first substrate is coated with the buffer layer by a device selected from a group consisting of an e-gun evaporation system or a sputtering system.

16. The method according to claim 1, wherein the buffer layer is coated with the catalytic layer by a device selected from a group consisting of an e-gun evaporation system or a sputtering system.

17. The method according to claim 1, wherein the second substrate is coated with the transparent electrode film by a device selected from a group consisting of an e-gun evaporation system or a sputtering system.

* * * * *